United States Patent [19]

Young

[11] 4,231,131

[45] Nov. 4, 1980

[54] INFLATABLE HIGH SPEED BOAT

[76] Inventor: Eldon L. Young, 3236 Wesleyan Dr., Anchorage, Ak. 99504

[21] Appl. No.: 947,955

[22] Filed: Oct. 2, 1978

[51] Int. Cl.[3] ..... B63B 7/08

[52] U.S. Cl. ..... 9/2 C; 9/2 A; 114/61; 114/182

[58] Field of Search ..... 9/2 R, 2 C, 2 A, 2 F, 9/11 A; 114/61, 182

[56] References Cited

U.S. PATENT DOCUMENTS

| | | | |
|---|---|---|---|
| 1,555,080 | 9/1925 | Scheibert | 9/2 A |
| 2,141,799 | 12/1938 | Pyle | 9/2 F |
| 2,660,142 | 11/1953 | Swenson | 114/182 |
| 3,383,719 | 5/1968 | Heide | 9/2 C |
| 3,694,836 | 10/1972 | Serra | 9/2 A |

FOREIGN PATENT DOCUMENTS

| | | | |
|---|---|---|---|
| 607106 | 7/1960 | Italy | 9/2 A |

*Primary Examiner*—Sherman D. Basinger
*Attorney, Agent, or Firm*—K. S. Cornaby

[57] ABSTRACT

A collapsible, inflatable boat is provided having two large inflatable tubes as hulls connected together by a floor raised above the midpoint of the hull tubes and supported by spaced-apart, laterally-extending rigid members flexible connected thereto. An inflatable, semi-tubular chamber is disposed beneath the floor and extends longitudinally of the boat midway between the hull tubes. A hinged, rigid transom is provided at the rear of the boat, and a forward end member closes the front of the boat to permit collapsing of the boat to a relatively small package without having to remove any parts from the boat.

7 Claims, 7 Drawing Figures

INFLATABLE HIGH SPEED BOAT

FIELD OF THE INVENTION

This invention relates to collapsible, inflatable boats of a type which are capable of being safely propelled at higher planing speeds, generally referred to as runabouts.

BACKGROUND OF THE INVENTION

In recent years, there has been increasing interest in inflatable boats because of their inherent advantages, including convenience, portability and safety. In the case of inflatable runabouts, all prior boats have relied upon some form of rigid bottom such as shown in U.S. Pat. No. 3,694,836 and 3,812,805, to which the inflatable side tubes are attached, or to some form of detachable floorboards or stiffening devices which must be separately inserted into the boat and joined by various means, as disclosed in U.S. Pat. No. 3,566,425. In the case of the former, the portability of the boat is seriously limited by the size and weight of the rigid bottom, whether comprised of one or more parts or sections. Therefore, boats of this character are not truly collapsible. In the case of the latter, the ease and convenience of use is adversely affected by the required assembly functions and by the separate parts which can be lost or damaged.

Because of the hydrodynamic forces exerted upon the hull of a boat when displacement speeds are exceeded, the hull must achieve a relatively high degree of rigidity. Without such rigidity, the hull can be deformed by these hydrodynamic forces to such a degree that it will not properly rise over the bow wave that is created in the water by the forward motion of the boat. Prior art collapsible, inflatable runabouts as exemplified by U.S. Pat. No. 3,261,038, have relied upon some means of creating a modified vee bottom between the inflatable side tubes consisting of coated fabric stretched into the desired shape by a rigid or inflatable keel which is, in turn, supported by a floorboard assembly. Thus the shape of the bottom planing surface of the boat and therefore the performance of the boat is largely dependent upon the keel and floorboard assembly.

Another characteristic of all prior collapsible, inflatable runabouts is that the bottom of the cockpit is located near or below the bottom of the inflatable tubes and is below the waterline of the boat when the boat is in use. Therefore, water which enters the boat due to rain, spray or other causes, will collect inside the cockpit unless removed by the occupants of the boat. Although some inflatable runabouts are equipped with devices referred to as self-bailers, these devices will drain water from the cockpit only when the boat is moving through the water at relatively high speed. In rough water conditions or at other times when high speed is impossible or impractical, the comfort of the occupants and the performance of the boat can be adversely affected by water collecting inside the cockpit of the boat.

SUMMARY OF THE INVENTION

The present invention provides for an improved collapsible, inflatable boat which is not subject to the disadvantages exhibited by boats of the type known from the prior art.

To prepare the boat according to this invention for use, all that is required is inflation of the air chambers. No assembly of separate parts is necessary; and yet, when inflated, the boat is capable of being safely propelled at planing speeds by powerful outboard motors. When deflated, the boat can be folded as a single unit into one compact package for easy and convenient transport or storage. The need for mechanical assembly and disassembly is completely eliminated.

These advantages are achieved by the use of two or more large diameter inflatable tubes as the hulls of the boat. The lower portions of these large diameter tubes become the planing surfaces of the boat at higher speeds. These large diameter tubes are constructed of coated fabric of a type having low stretch and high stiffness characteristics. The combination of large diameter tubes and low stretch, high stiffness fabric provides sufficient rigidity when the tubes are inflated to a pressure of 3 or more p.s.i. to permit safe high speed operation without reliance on a shaped fabric bottom between the tubes which would require assembled floor and/or keel members.

The boat according to this invention has a cockpit floor which is raised to the approximate vertical mid-point of the hull tubes. This places the floor above the waterline of the boat even when the boat is fully loaded. The underside of the floor does not become a part of the planing surfaces of the boat. Therefore, the performance of the boat is not affected by the floor.

Because the cockpit floor is above the waterline of the boat at all times, drains are preferably provided through the transom to allow all water entering the boat to drain from the boat by gravity. No external action or effort is required. Water cannot collect inside the boat because it is self-bailing whether this boat is at rest or in motion.

To further improve the operational characteristics of the boat, an inflatable semi-tubular chamber extends longitudinally of the boat beneath the cockpit floor at the lateral mid-point between the main tubes and is connected at one end to a hingedly attached, rigid transom extension at the rear and, at the other end, to a fixed frontpiece beneath the forward portion of the cockpit floor. This deflector chamber increases the efficiency of outboard motor propulsion by creating a smooth flow of water to the propeller. It reduces the splash and spray around the transom by diverting water that would otherwise flow against the lower unit of the outboard motor above the level of the cavitation plate. It also provides additional flotation capacity when the boat is heavily loaded and provides additional stiffening for the cockpit floor. The rigid rear transom extension to which the deflector chamber is connected can be folded forward for compact storage when the boat is deflated and is held in the proper position for use by air pressure when the deflector chamber is inflated.

The cockpit floor is constructed of coated fabric supported by transverse rigid members which also act as spreaders to maintain the main hull tubes in position parallel to each other. The floor supports are spaced longitudinally and are flexibly connected by the coated floor fabric which allows the rigid members to be folded with the deflated boat into one compact package. The size of the floor supports and the distance between them may be varied for different boat sizes and expected uses. Attachment of the inflatable deflector chamber to the underside of the floor supports provides additional support to the floor structure.

The cockpit is defined by the rigid transom upon which an outboard motor can be mounted, the main inflatable hull tubes at the sides, and by an inflatable tube extending laterally across the front of the boat or by other means explained below. The main inflatable tubes are shaped with generally conical rear extensions for minimum drag and with raised front extensions or bows for maximum lift when the boat is in motion through the water.

The front of the cockpit connecting the bows of the main inflatable hull tubes may be constructed by various means, including a transverse inflatable tube or thwart; a fixed, rigid member such as tubular aluminum or rigid polyvinyl-chloride; or a segmented member which, when extended and fixed in position, becomes essentially rigid and when collapsed allows the boat to be folded to more compact dimensions. The preferred embodiment is a segmented, tubular member consisting of smaller sections sliding inside a larger diameter center section and locking in a fixed position by means of attached retaining pins. This means allows collapsing to compact dimensions, occupies less cockpit space than an inflatable tube or thwart, provides a rigid member to which accessory items may be attached, and functions as a convenient handle for lifting or pulling the boat.

The boat according to this invention preferably uses larger diameter inflatable tubes than are used in equivalent length boats of prior art. These large tubes are divided into multiple air chambers by air tight bulkheads. Because of the larger volume of air enclosed by the tubes, the boat provides a greater safety factor in terms of extra flotation capacity in the event of accidental damage to the boat.

THE DRAWINGS

A preferred embodiment of the invention is illustrated in the accompanying drawings, in which:

FIG. 1 is a side elevational view of the boat afloat in a body of water;

FIG. 2, a top plan view of the boat;

FIG. 3, an enlarged sectional view of the forepart of the boat taken along Line 3—3 of FIG. 2;

FIG. 4, an enlarged sectional view of the rear part of the boat taken along Line 4—4 of FIG. 2;

FIG. 5, a partial view of the transom connection with the floor shown in FIG. 4, with the two parts of the transom collapsed on the floor;

FIG. 6, a front elevational view of the boat; and

FIG. 7, a rear elevational view of the boat.

DETAILED DESCRIPTION OF THE ILLUSTRATED EMBODIMENT

As shown in FIGS. 1, 2, 3, 4, 6 and 7 of the accompanying drawing, a boat 10 of the invention has two large diameter hull tubes 11, 12 preferably constructed of a non- or low-stretch fabric having high stiffness. Hull tubes 11, 12 are arranged in parallel longitudinal relationship and are joined together by means of a fabric floor 13, preferably constructed of a material similar to the hull tubes. Floor 13 is preferably disposed above the surface of the water and has crossmembers 14 extending laterally across the floor 13 in spaced-apart relationship. Crossmembers 14 are preferably constructed of wood, plastic or other rigid material and are permanently attached in place in floor 13 to provide rigidity and to maintain hull tubes 11, 12 in proper spaced-apart relationship.

Figure 1:
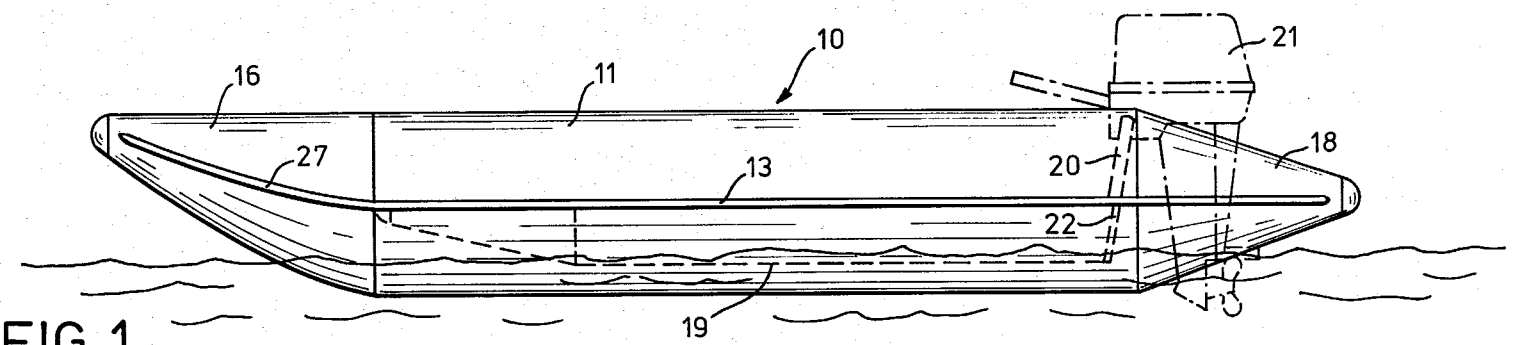
Figure 2:
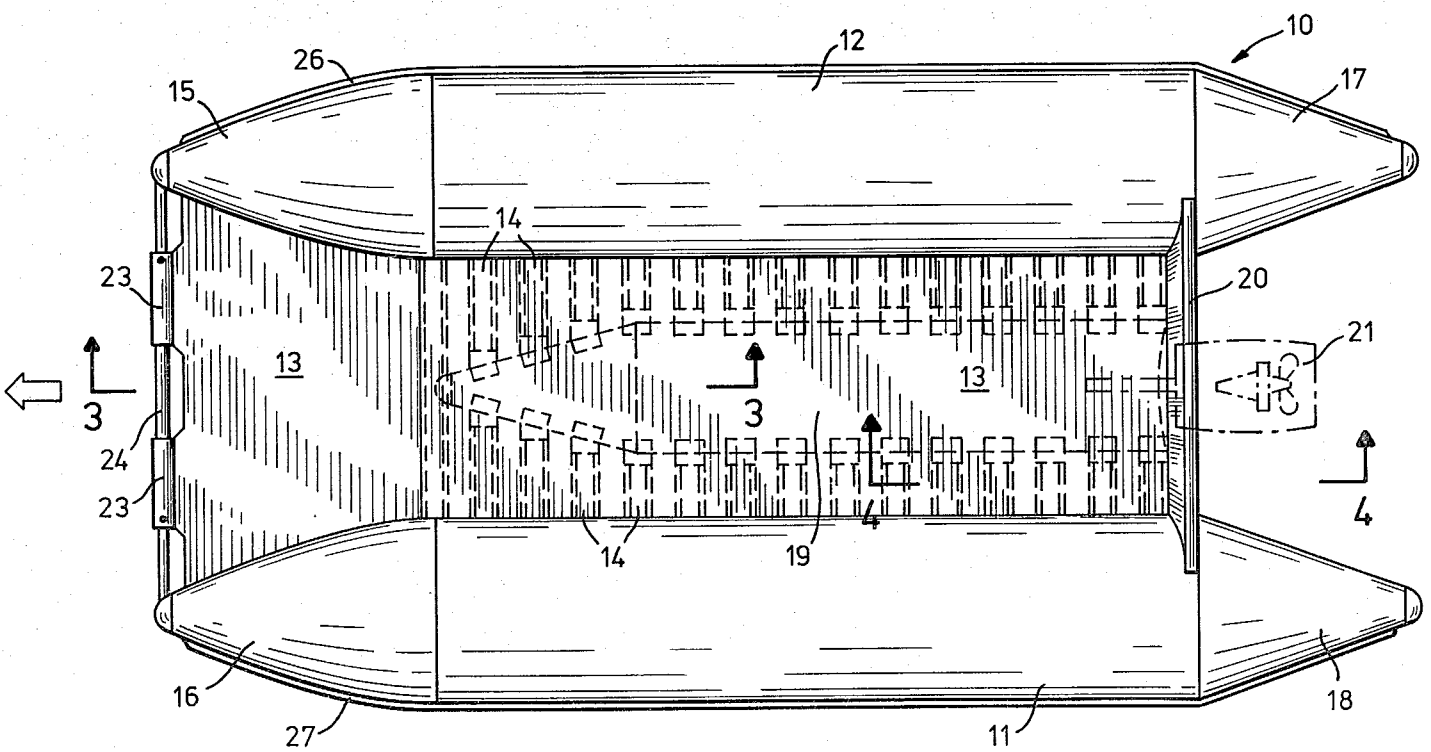
Figure 4:
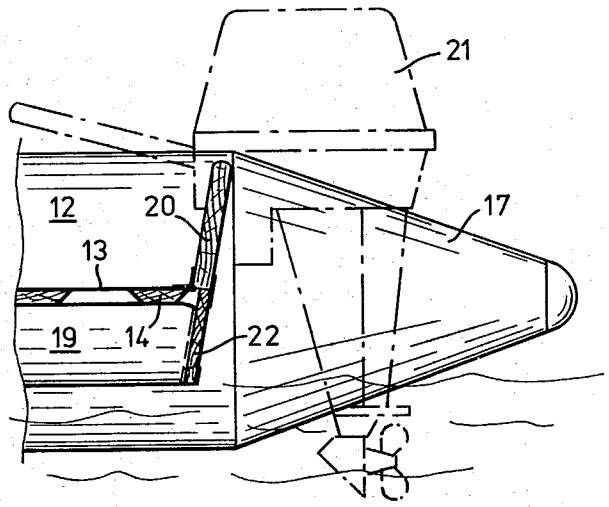
Figure 3:
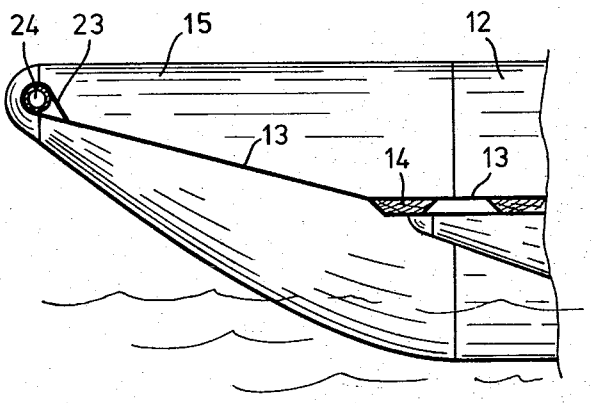

As seen in FIGS. 3 and 4, hull tubes 11, 12 have upturned forward portions 15, 16 to provide enhanced planing ability and maximum lift when the boat undertakes high speed travel, and have extended conical rear portions 17, 18 to provide minimum drag.

A preferably semi-tubular, inflatable chamber 19 is disposed midway between the two hull tubes 11, 12 and extends longitudinally of boat 10 under floor 13. Chamber 19 is also preferably constructed of non-stretch, high stiffness material and serves to provide support to the center of the floor 13.

Figure 5:
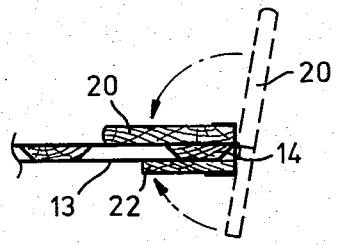

A rigid transom 20 preferably constructed of wood, plastic or the like is disposed at the rear of floor 19 between hull tubes 11, 12 and serves to support one or more outboard motors 21. Transom 20 is hinged at floor 13 to fold forward against floor 13 for stowage, as shown in FIG. 5. FIG. 5 also illustrates a lower hinged transom portion 22, which helps control backwash in the area around the propeller of motor 21. Lower transom portion 22 also folds forward and upwardly against the lower side of floor 13 for stowage.

The forward bow of the boat is preferably formed as an upward extension of floor 13, the leading edge of which in this embodiment is connected by flaps 23 around sectional tubular pole 24, which is collapsible and can be compressed for storage to a fraction of its length. Other means of attaching the leading edge of floor 13 can be employed.

Figure 7:
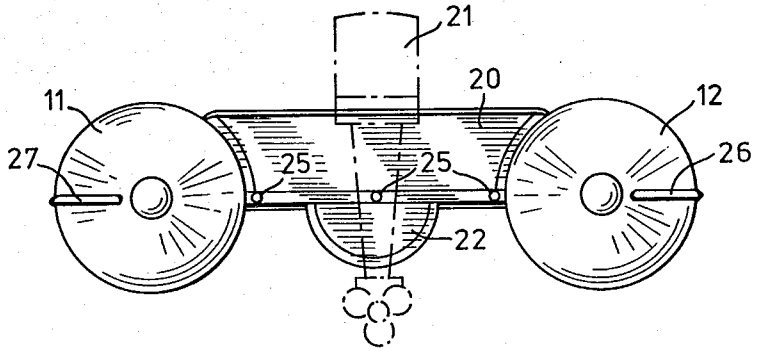
Figure 6:
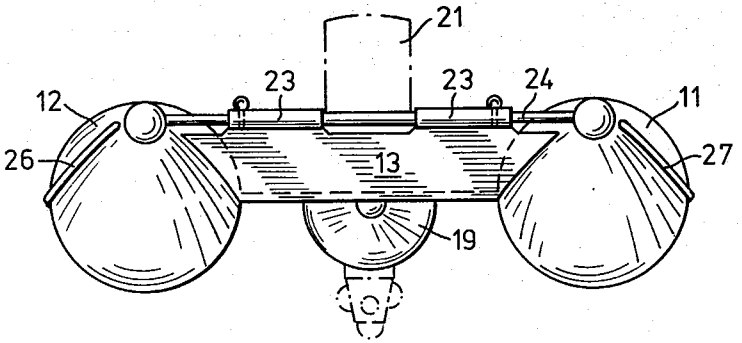

It is preferred that apertures 25 be located at the floor level at the rear of the boat to permit water entrapped in the boat to flow from the boat. Apertures 25 are preferably located near the outside edges near the hull tubes as shown in FIG. 7. A pair of bumper strips and splash guards 26, 27 preferably extend along the outside edges of hull tubes 11, 12 to minimize splash during high speed planing and to protect the hull tubes during docking.

In addition to the primary advantages of convenience, portability and safety, the boat according to this invention is also versatile and adaptable to many uses. It can be more easily propelled by the use of oars than inflatable runabouts of prior art. It can be fitted with fixed or detachable skegs for greater directional stability and manuverability, it can be fitted with accessory equipment for sailing, and it can easily be fitted with seats, storage compartments, spray curtains and other such equipment. It can also be fitted with a special rescue package for use as a manuverable life raft.

It is to be understood that the particular forms of the invention described herein and illustrated in the accompanying drawings are preferred embodiments. Various changes in size, shape, materials and arrangements of parts can be made without departing from the scope of the invention as defined in the attached claims.

I claim:

1. A collapsible inflatable boat for high-speed travel, comprising in combination:

a pair of inflatable tubes arranged in parallel, spaced-apart relationship;

a floor member connecting said tubes and disposed so as to extend above the water when said tubes are on a body of water, said floor member having permanently attached, rigid, spaced-apart support members extending laterally of said floor member between said pair of tubes;

a third inflatable member permanently attached to the underside of said floor member for support and extending longitudinally of the boat to the rearward edge of said floor member;

a rigid, hinged upper transom member permanently attached to the rearward edge of said floor member and which is foldable forwardly against the upper side of said floor member when not in use;

A rigid, hinged lower transom member permanently attached to the rearward edge of said third inflatable member below said upper transom member, and which is foldable forwardly when not in use; and a leading edge bow member disposed at the forward end of said floor member.

2. A boat as set forth in claim 1, wherein said leading edge bow member comprises a telescoping rod extending between said two inflatable tubes with the forward edge of said floor member attached thereto.

3. A boat as set forth in claim 1, wherein said transom has apertures therein to drain unwanted water from the interior of the boat.

4. A boat as set forth in claim 1, including bumper splash strips extending along the outer sides of said inflatable tubes.

5. A boat as set forth in claim 1, wherein said tubes, inflatable member and floor member are of stretch-resistant, stiff material.

6. A boat as set forth in claim 1, wherein the forward ends of said tubes are generally shaped upwardly.

7. A boat as set forth in claim 1, wherein the rearward ends of said tubes are shaped generally conically.

* * * * *